US008317944B1

(12) United States Patent
Jablonski et al.

(10) Patent No.: US 8,317,944 B1
(45) Date of Patent: Nov. 27, 2012

(54) 9 CR— 1 MO STEEL MATERIAL FOR HIGH TEMPERATURE APPLICATION

(75) Inventors: Paul D. Jablonski, Salem, OR (US); David Alman, Corvallis, OR (US); Omer Dogan, Corvallis, OR (US); Gordon Holcomb, Albany, OR (US); Christopher Cowen, Albany, OR (US)

(73) Assignee: U.S. Department of Energy, Washington, DC (US)

( * ) Notice: Subject to any disclaimer, the term of this patent is extended or adjusted under 35 U.S.C. 154(b) by 0 days.

(21) Appl. No.: 13/282,211

(22) Filed: Oct. 26, 2011

Related U.S. Application Data

(60) Division of application No. 12/209,488, filed on Sep. 12, 2008, now Pat. No. 8,246,767, which is a continuation-in-part of application No. 11/226,283, filed on Sep. 15, 2005, now Pat. No. 7,553,517.

(51) Int. Cl.
*C22C 38/00* (2006.01)

(52) U.S. Cl. ..... 148/325; 148/607; 148/611; 148/605; 148/622; 148/664; 148/326; 420/68; 420/71

(58) Field of Classification Search ..... 148/325
See application file for complete search history.

(56) References Cited

U.S. PATENT DOCUMENTS 3,369,892 A * 2/1968 Ellis et al. ..... 75/236
3,953,201 A 4/1976 Wood et al.
4,261,739 A 4/1981 Douthett et al.
4,461,811 A 7/1984 Borneman et al.
4,581,066 A 4/1986 Maruhashi et al.
4,640,722 A 2/1987 Gorman
4,834,808 A 5/1989 Hill
4,964,926 A 10/1990 Hill
5,051,234 A 9/1991 Shinagawa et al.
5,310,431 A 5/1994 Buck et al.
5,843,370 A 12/1998 Koyama et al.
5,851,316 A 12/1998 Yazawa et al.
6,514,359 B2 2/2003 Kawano et al.
2006/0054253 A1 3/2006 Fujitsuna et al.

* cited by examiner

*Primary Examiner* — Roy King
*Assistant Examiner* — Christopher Kessler
(74) *Attorney, Agent, or Firm* — James B. Potts; Mark P. Dvorscak; John T. Lucas

(57) ABSTRACT

One or more embodiments relates to a high-temperature, titanium alloyed, 9 Cr-1 Mo steel exhibiting improved creep strength and oxidation resistance at service temperatures up to 650° C. The 9 Cr-1 Mo steel has a tempered martensite microstructure and is comprised of both large (0.5-3 μm) primary titanium carbides and small (5-50 nm) secondary titanium carbides in a ratio of. from about 1:1.5 to about 1.5:1. The 9 Cr-1 Mo steel may be fabricated using exemplary austenizing, rapid cooling, and tempering steps without subsequent hot working requirements. The 9 Cr-1 Mo steel exhibits improvements in total mass gain, yield strength, and time-to-rupture over ASTM P91 and ASTM P92 at the temperature and time conditions examined.

14 Claims, 2 Drawing Sheets

9 CR— 1 MO STEEL MATERIAL FOR HIGH TEMPERATURE APPLICATION

RELATION TO OTHER APPLICATIONS

This patent application is a divisional of and claims the benefit of U.S. patent application Ser. No. 12/209,488 filed on Sep. 12, 2008, now U.S. Pat. No. 8,246,767, which is hereby incorporated by reference in its entirety. U.S. application Ser. No. 12/209,488 is a continuation-in-part of and claims priority to U.S. patent application Ser. No. 11/226,283, filed on Sep. 15, 2005, now U.S. Pat. No. 7,553,517, which is hereby incorporated by reference in its entirety.

GOVERNMENT INTERESTS

The United States Government has rights in this invention pursuant to the employer-employee relationship of the Government to the inventors as U.S. Department of Energy employees mid site-support contractors at the National Energy Technology Laboratory.

FIELD OF THE INVENTION

One or more embodiments relates to a high-temperature, titanium alloyed, 9 Cr-1 Mo steel exhibiting improved creep strength and oxidation resistance at service temperatures up to 650° C. The 9 Cr-1 Mo steel has a tempered martensite microstructure and is comprised of both large (0.5-3 μn) primary titanium carbides and small (5-50 nm) secondary titanium carbides. The primary titanium carbides contribute to creep strength while the secondary titanium carbides act to maintain a higher level of chromium in the finished steel for increased oxidation resistance, and strengthen the steel by impeding the movement of dislocations through the crystal structure

BACKGROUND

The constraints placed on power generation in terms of environmental impact and economics have focused attention on the development of high efficiency, low emission systems. Increasing in the thermal efficiency of a power plant is most effectively achieved by increasing the temperature of the steam driving the power-producing turbine. Currently, typical steam power efficiencies are around 42%, with steam temperatures of 600° C. and pressures of 25-30 MPa. Increasing the operating steam temperature to 625-650° C. will enable thermal efficiencies of around 45% to be achieved. However, the increasing operating temperatures and pressures impose increasingly stringent requirements on the materials of construction.

A well-known material capable of satisfying the requirements noted above is austenitic stainless steel. However, austenitic stainless steel is relatively expensive, and its use in commercial plants is limited for economic reasons. In addition, austenitic stainless steel has a large thermal expansion coefficient and can experience relatively large thermal stresses during transient plant operations, start-up, and shutdown. For these reasons, the use of austenitic stainless steel in plants is problematic. More often, 9 Cr-1 Mo steels, such as ASTM P91 and ASTM P92, among others, are used as an effective-compromise to balance cost and high-temperature demands.

The 9 Cr-1 Mo steels such as ASTM P91 and ASTM P92, among others, generally provide sufficient strength, resistance to corrosion and oxidation, low thermal expansion, and adequate fatigue resistance. The high chromium (Cr) content in these steels results in an oxide film composed of outer layer iron (Fe) oxides and inner layer Cr oxides or Fe—Cr oxides. Generally, Cr in an amount of not smaller than 8.0% is necessary to form a sound oxide film, while an upper limit of approximately 9.5% is established to allow consistent weldability. Molybdenum (Mo) is used as a solid-solution hardening element and a precipitation-hardening element to form highly dispersed carbides and improve the high temperature creep strength of the steels. Mo is limited to approximately 1% or less, because exposure of the 9 Cr-1 Mo steels with Mo at 600-650° C. has been shown to result in the precipitation of Laves-phase, which removes the element from solid solution and reduces solid-solution strengthening. Additionally, these steels have a typical carbon (C) content of approximately 0.1 wt %, which provides sufficient strength while allowing the material to respond well to hot and cold bending, as well as to welding. The stress rupture strengths of these steels are increased by the addition of carbide formers Niobium (Nb) and Vanadium (V). Tungsten (W) is further added to ASTM P92 to allow operations at slightly higher temperatures than P91, but at increased cost. However, in the currently sought temperature environment of 625-650° C., none of the currently used high-temperature steels such as ASTM P91 and ASTM P92, among others, have a satisfactory level of resistance to oxidation and corrosion, and typically the highest service temperature achievable is limited to 625° C.

The resistance to oxidation and corrosion at higher temperatures can be achieved by increasing the content of Cr to improve oxidation resistance, and adding nickel (Ni) to suppress any resulting 6-ferrite, however a high alloy steel with a high content of Cr and Ni significantly increases cost and becomes comparable to an 18-8 austenitic stainless steel from an economic standpoint. Similarly, cobalt (Co) can be utilized to improve the performance of 9 Cr-1Mo steels at higher temperature, but like W and Ni, the addition of Co can be unattractive economically. It would be advantageous to produce a material similar in composition to commonly used high-temperature steels such as ASTM P91 and ASTM P92 that utilizes a relatively inexpensive alloying addition for increased high-temperature performance.

Titanium (Ti) is an economically attractive alloying element and has been investigated for 9 Cr-1 Mo steels. Typically, Ti has been added as a stabilizer preventing sensitization for applications where high strength requirements limit the degree to which C can be reduced. This practice exploits the stronger tendency of Ti over Cr to form carbides, thus permitting the matrix to retain the corrosion inhibiting Cr. However, it is known that Ti can impart brittleness, and the use of Ti as a stabilizer typically emphasizes a Ti content as low as possible, but at a ratio to C or C plus nitrogen (N) on the order often or more. See Grubb, et al, "Micromechanisms of Brittle Fracture in Titanium-stabilized and α-Embrittled Ferritic Stainless Steels," *Toughness of Ferritic Stainless Steels*, American Society of Testing and Materials STP 706 (1980). This combination of requirements tends to necessitate a relatively low carbon level of typically 0.03% or less when Ti stabilization is utilized, which limits application where higher strengths and hardness are required. See U.S. Pat. No. 5,851,316, issued to Yazawa, et al, issued Dec. 22, 1998; U.S. Pat. No. 5,843,370, issued to Koyama, et al, issued Dec. 1, 1998; U.S. Pat. No. 5,051,234, issued to Shinagawa, et al, issued Sep. 24, 1991; U.S. Pat. No. 4,640,722, issued to Gorman, issued Feb. 3, 1987; U.S. Pat. No. 4,461,811, issued to Borneman, et al, issued Jul. 24, 1984; U.S. Pat. No. 4,261,739, issued to Douthett, et al, issued Apr. 14, 1981; U.S. Pat. No. 3,953,201, issued to Wood, et al, issued Apr. 27, 1976. Ti and Nb have also been used in combination for stabilization, but low carbon levels remain a requirement. Additionally, Mo is often treated as an optional or impurity element. See U.S. Pat. No. 4,964,926, issued to Hill, issued Oct. 23, 1990; U.S. Pat. No. 4,834,808, issued to Hill, issued May 30, 1989; U.S. Pat. No. 4,581,066, issued to Maruhashi, et al, issued Apr. 8, 1986.

Ti has also been utilized in 9 Cr-1 Mo steels as a carbide-forming agent which contributes to precipitation strengthening. Precipitation strengthening with Ti requires the dissolution of primary titanium carbides by austenization at high temperature, often greater than 1300° C., in order to dissolve the low-solubility primary titanium carbide as completely as possible. On reheating, fine precipitates of secondary titanium carbide typically less than 30 nm in size distribute throughout the matrix and provide strengthening by acting to impede the movement of dislocations. Dissolution of all or most of the primary titanium carbide during austenization is usually specified, and remaining primary titanium carbides are strictly minimized to avoid degradation of creep properties. Hot working in the austenite temperature range can also be specified to further promote the dissolution of the primary titanium carbides. The latter step, in particular, adds significant processing time and cost to a typical heat treatment that might otherwise consist solely of austenization, cooling, and tempering. See e.g., U.S. Pat. No. 5,310,431, issued to Buck, issued on May 10, 1994; U.S. patent application Ser. No. 11/250,492, submitted by Fujitsuna, et al, published Mar. 16, 2006; U.S. Pat. No. 6,514,359, issued to Kawano, issued Feb. 4, 2003.

It would be advantageous to provide an improved 9Cr-1Mo steel material primarily utilizing an additive alloying element, Ti, that is relatively inexpensive as compared to W, Ni, Co, or other alloying element additions, in order to produce a material comparable in cost to currently used high-temperature 9 Cr-1 Mo materials such as ASTM P91 and ASTM P92, among others. It would be additionally advantageous if the 9Cr-1Mo steel could be fabricated through an austenization, rapid cooling, tempering, and final cooling cycle to avoid costly and time-consuming requirements associated with hot-working in the austenite temperature range. It would be additionally advantageous is the 9 Cr-1 Mo steel provided improved high-temperature creep strength and improved oxidation and corrosion resistance in a temperature environment of 625-650° C. as compared to typical 9 Cr-1 Mo materials such as ASTM P91 and ASTM P92.

SUMMARY

The novel 9Cr-1Mo steel described herein is comprised of titanium carbides present as both primary TiC and secondary TiC. The simultaneous presence of these titanium carbides within the heat treated 9Cr-1Mo steel greatly increases the high-temperature creep strength and oxidation resistance over that of economically comparable high-temperature 9 Cr-1 Mo materials, such as ASTM P91 and ASTM P92, among others.

The composition of the 9 Cr-1 Mo steel is comprised of at least Fe, Chromium (Cr), Molybdenum (Mo), Carbon (C), Titanium (Ti), The 9 Cr-1 Mo steel may be further comprised of silicon, manganese, vanadium, niobium, and nickel. The 9 Cr-1 Mo steel is additionally comprised of primary TiC grains and secondary TiC grains, where the ratio of primary TiC grains to secondary TiC grains is from about 1:1.5 to about 1.5:1. The primary TiC grains are from about 0.5 μm to about 3.0 μm in diameter and the secondary TiC grains are from about 5 nm to about 50 μm in diameter. The tempered martensite microstructure is comprised of ferrite (α-Fe) and cementite ($Fe_3C$). An exemplary austenization and tempering heat treatment may be utilized in order to generate the primary and secondary TiC in the ratios specified.

The primary TiC acts to control grain growth by pinning grain boundaries and increasing grain boundary strength and cohesion. The ability of primary TiC to resist dissolution is essential to resisting austenitic grain growth at high temperatures during initial solidification, subsequent heat treatments, and processes producing heat-affected zones, such as welding. The secondary TiC reduces the formation of chromium carbides, maintaining a higher level of chromium to form a well adhered protective oxide scale for oxidation resistance. Within the novel heat treated 9Cr-1Mo alloy described herein, the secondary TiC are essential for increasing oxidation resistance, strength, and long-term stability of the microstructure for prolonged services at elevated temperatures.

In an embodiment, the mass gain of the heat treated 9 Cr-1 Mo steel compared to ASTM P91 tested for up to 1500 hours at 650° C. in 3% moist air demonstrated a total mass gain of the heat treated 9 Cr-1 Mo steel disclosed about 5 times lower than ASTM P91. Tensile testing of the heat treated 9 Cr-1 Mo steel performed at temperatures of 550° C., 600° C., and 650° C. indicated that the yield strength of the 9 Cr-1 Mo steel was significantly higher than commercial ASTM P91 steel, demonstrating improvements of approximately 27% at 550° C., 65% at 600° C., and 73% at 650° C. The 9 Cr-1 Mo steel exhibited superior time-to-rupture over the currently used high-temperature 9Cr-1 Mo materials ASTM P91 and ASTM P92 at all temperature and time conditions examined.

The novel process and principles of operation are further discussed in the following description.

DETAILED DESCRIPTION

Figure 1:
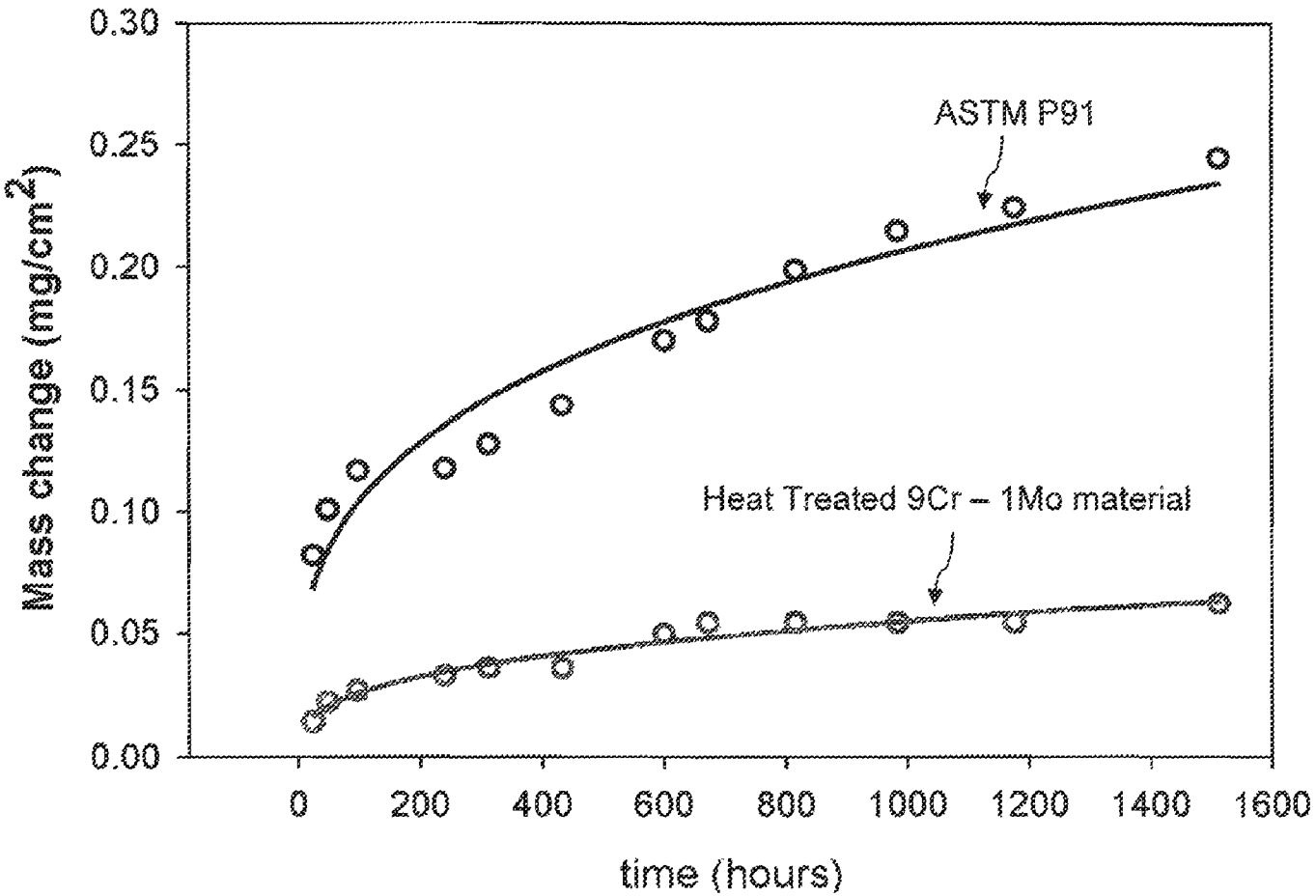
FIG. 1 shows the improved oxidation of the heat treated 9Cr-1Mo steel at 650° C. over comparison material ASTM P91.

The following description is provided to enable any person skilled in the art to use the invention and sets forth the best mode contemplated by the inventor for carrying out the invention. Various modifications, however, will remain readily apparent to those skilled in the art, since the principles of the present invention are defined herein specifically to provide a 9Cr-1Mo steel having a tempered martensite microstructure with titanium carbides present as both primary and secondary precipitates. The 9Cr-1Mo steel exhibits improved high-temperature creep strength and improved oxidation and corrosion resistance in a temperature environment of 625-650° C. while remaining economically comparable to the currently used high-temperature 9 Cr-1 Mo steels ASTM P91 and ASTM P92, among others.

The improved performance of the 9Cr-1Mo steel disclosed herein results from the addition of titanium. Generally speaking, titanium added to steel forms coarse and large carbides, nitrides, and carbonitride inclusions in the steel. This reduces the amount of strengthening carbides, nitrides, and carbonitrides which may otherwise form, for example, with V and Nb, and the creep strength of the steel is lowered. The inventors have found, however, that a 9Cr-1Mo steel containing both primary TiC for grain size refinement and increased grain boundary strengthening and cohesion, as well as secondary TiC distributed throughout the matrix for increased creep strength and oxidation resistance, significantly improves performance over typical 9Cr-1Mo materials such as ASTM P91 and ASTM P92, among others. Additionally, the 9Cr-1Mo steel may be fabricated without any associated hot-working requirements such as forging, rolling, extrusion, or swaging.

9 Cr-1 Mo Steel Composition

The composition of the 9 Cr-1 Mo steel is comprised of at least Chromium (Cr), Molybdenum (Mo), Carbon (C), Titanium (Ti), and potentially additional elements, with the balance Iron (Fe) and other impurities. The composition is preferably restricted to a particular one for the following reasons.

Chromium:

Chromium is added to give the steel a satisfactory level of hot corrosion resistance, and is an essential element in the formation of a stable oxide scale for high-temperature oxidation resistance. With a Chromium content under 8.0 wt. %, the desired effect cannot be obtained. However, with a Chromium content over 13.0 wt. %, the amount of delta-ferrite increases to impair strength and toughness. Therefore, the Chromium content should be limited within the range 8.0-13.0 wt. %, and preferably 8.0-9.5 wt. %.

Molybdenum:

Molybdenum is added to achieve solution strengthening and improve creep strength. With a molybdenum content under 0.5 wt. %, the desired effect cannot be obtained. However, with a molybdenum content over 1.5 wt. %, during service lifetimes in high temperature environments, precipitation of a Laves phase ($Fe_2Mo$) significantly impacts toughness. Therefore, the molybdenum content should be limited within the range 0.5-1.5 wt. %, and preferably 0.85-1.05 wt. %.

Carbon:

Carbon combines with Cr, Mo, V, Ti and Nb to form carbide phases, which result in improved high-temperature creep strength and increased microstructural stability under prolonged exposures at elevated temperature. With reduced carbon content, the ferritic structure is stabilized, degrading the strength due to the decreased amount of austenite available to transform to martensite upon quenching. With increased carbon content, the $Ac_1$ point may decrease markedly, reducing applicability for high temperature service. Additionally, an increase in the amount of C may increase the hardness to an undesirable level, degrading formability and weldability. Therefore, the carbon content should be limited within the range 0.05-0.15 wt. %, and preferably 0.08-0.12 wt. %.

Titanium:

Titanium has the function of producing stable carbides that result in higher creep strength, long term microstructural stability, and improved oxidation resistance. The heat treated material provided by this invention utilizes titanium carbides as both primary and secondary precipitates. The primary TiC are relatively large (0.5-3 μm) and are formed during steel production prior to the heat treatment of the invention. The 9 Cr-1 Mo steel typically retains about 60-40% and preferably about 50% of the primary TiC for creep strength and grain boundary pinning/strengthening in the finished steel. The 9 Cr-1 Mo steel additionally includes small (5-50 nm) secondary TiC. The secondary TiC may be formed through a heat treatment which dissolves the remaining about 40-60% and preferably about 50% of the primary TiC and precipitates the secondary TiC through austenization and tempering. The 9Cr-1Mo steel thus contains secondary TiC and primary TiC in a secondary to primary ratio from about 1:1.5 to about 1.5:1, and preferably about 1:1. The secondary TiC assists in maintaining a higher level of chromium in the finished steel for increased oxidation resistance, and strengthens the novel heat treated material by impeding the glide and climb of matrix phase dislocations throughout the microstructure.

With a titanium content under 0.05 wt. %, the desired effect cannot generally be obtained. However, with a titanium content over 0.2 wt. %, excessively large carbides may result in the matrix. These large carbides are deleterious to mechanical properties as they typically acts as stress concentration risers. Therefore, the titanium content should be limited to within the range 0.05-0.2 wt. %, and preferably 0.05-0.15 wt. %.

Silicon (Si):

Silicon is added as a deoxidizing agent, to improve the castability, and to increase resistance to steam oxidation. With a silicon content under 0.01 wt. %, the desired effect cannot be obtained. However, with a silicon content over 1.0 wt. %, the amount of ferrite in the steel increases, thus leading to lower toughness and impaired creep strength. Therefore, the silicon content should be limited within the range 0.1-1.0 wt. %, and preferably 0.2-0.5 wt. %.

Manganese (Mn):

Manganese is added to improve hot formability and to facilitate the removal of impurities such as phosphorus and sulfur during melting. With a manganese content under 0.2 wt %, the desired effect cannot be obtained. However, with a manganese content over 1.0%, a hardened phase is formed, impairing toughness. Therefore, the manganese content should be limited within the range 0.2-1.0 wt. %, and preferably 0.2-0.5 wt. %.

Vanadium (V):

Vanadium combines with carbon and nitrogen to form finely dispersed precipitates such as V(C,N), which are stable at high temperature for an extended period of time. The dispersed V(C, N) is effective for improving long-term creep strength. With a vanadium content under 0.1 wt. %, the desired effect cannot be obtained. However, with a vanadium content over 0.4 wt. %, creep strength is impaired. Therefore, vanadium content should be limited within the range 0.1-0.4 wt. %, and preferably 0.18-0.25 wt. %.

Niobium (Nb):

Niobium, like vanadium, combines with carbon and nitrogen to form fine precipitates such as Nb (C, N) which are effective to improve creep strength. Additionally, niobium-rich precipitates aid to prevent fine crystal grains of austenite from coarsening during the austenizing heat treatment. With a niobium content under 0.02 wt. %, the desired effect cannot be obtained. However, with a niobium content over 0.2 wt. %, the formed Nb (C,N) coarsens and impairs creep strength and toughness. Therefore, niobium content should be limited within the range 0.02-0.2 wt. %, and preferably 0.06-0.10 wt. %.

Nitrogen (N):

Nitrogen, when present, combines with vanadium and niobium to form carbonitrides, which are effective to improve creep strength. However, with a nitrogen content over 0.07 wt. %, the formability and weldability are degraded. Therefore, nitrogen content should be limited to less than 0.07 wt. %, and preferably 0.05 wt. % or less.

Nickel (Ni):

Nickel, when present, is an austenite stabilizer, and may be added to effectively stabilize a martensitic structure after quenching. However, when the nickel content is over 0.8 wt. %, the creep strength is lowered. Additionally, increases in nickel content have a significant impact on cost. Therefore, the nickel content should be limited to about 0.8 wt. % or less, and preferably 0.4 wt. % or less.

Phosphorus (P) and Sulfur (S):

Phosphorus and Sulfur are unavoidable impurities adversely affecting toughness, formability, and weldability. Phosphorus should be limited to an amount less than 0.03 wt. %, preferably less than 0.02 wt. %. Sulfur should be limited to an amount less than 0.03 wt. %, and preferably less than 0.01 wt. %.

Aluminum (Al):

Aluminum may be added as a deoxidizing agent. However, when the aluminum content is over 0.06 wt. %, the high-temperature creep strength and toughness is deteriorated. Therefore, the aluminum content should be limited to about 0.06 wt. % or less, and preferably 0.04 wt. % or less.

Principles of the Method

The novel 9Cr-1Mo steel described herein may be fabricated by exploiting the propensity of titanium to form stable, high solubility carbides, in order to produce a material wherein titanium carbides are present as both primary TiC and secondary TiC. The simultaneous presence of these titanium carbides within the heat treated 9Cr-1Mo steel greatly increases the high-temperature creep strength and oxidation resistance over that of economically comparable high-temperature 9 Cr-1 Mo materials, such as ASTM P91 and ASTM P92, among others. The balance of primary TiC and secondary TiC responsible for this improvement may be fabricated from careful control of austenization, rapid cooling, and tempering heat treatment steps.

The 9 Cr-1 Mo steel composition is prescribed such that primary TiC may be incorporated into the microstructure during the course of steel production by melting, casting, and hot fabrication. Titanium has a very strong affinity for carbon, and titanium carbide has high thermal and chemical stability. As a result, primary TiC will precipitate in steels at very low concentrations of titanium even at high temperatures. This primary TiC acts to control grain growth by pinning grain boundaries and increasing grain boundary strength and cohesion. The ability of primary TiC to resist dissolution is essential to resisting austenitic grain growth at high temperatures during initial solidification, subsequent heat treatments, and processes producing heat-affected zones, such as welding. A component that has experienced grain coarsening is liable to have low dimensional precision owing to quench-hardening distortion, reduced impact value and fatigue life, and, particularly in a high-strength component, degraded delayed fracture properties.

The novel 9Cr-1Mo steel described herein further exploits secondary TiC. Austenization may be specifically conducted in such a manner as to dissolve approximately half of the primary TiC, and place that titanium in solution. This titanium may be maintained in solution during and following the rapid cooling. During tempering, the titanium precipitates out from solution forming secondary TiC homogeneously distributed throughout the matrix of the alloy. The strong affinity of titanium for carbon results in preferential formation of this secondary TiC and reduces the formation of chromium carbides, maintaining a higher level of chromium to form a well adhered protective oxide scale for oxidation resistance. Within the novel heat treated 9Cr-1Mo alloy described herein, the secondary TiC are essential for increasing oxidation resistance, strength, and long-term stability of the microstructure for prolonged services at elevated temperatures.

Material Preparation

The 9 Cr-1 Mo steel having a tempered martensite microstructure is comprised of at least Fe, chromium, molybdenum, carbon, and titanium. The 9 Cr-1 Mo steel is comprised of primary TiC grains and secondary TiC grains, where the ratio of primary TiC grains to secondary TiC grains is from about 1:1.5 to about 1.5:1. The primary TiC grains are from about 0.5 μm to about 3.0 μm in diameter and the secondary TiC grains are from about 5 nm to about 50 nm in diameter. The tempered martensite microstructure is comprised of ferrite (α-Fe) and cementite ($Fe_3C$). The 9 Cr-1 Mo steel may be further comprised of silicon, manganese, vanadium, niobium, and nickel within the ranges prescribed.

The percentages of the elements may be varied within the following general ranges, in weight %:

Cr: 8.0-13.0
Mo: 0.5-1.5
C: 0.05-0.15
Ti: 0.05-0.2
Si: 0.1-1.0
Mn: 0.2-1.0
Mo: 0.5-1.5
V: 0.1-0.4
Nb: 0.02-0.2
Ti: 0.05-0.2
N: not more than 0.07
Ni: not more than 0.8
P: not more than 0.03
S: Not more than 0.03
Al: not more than 0.06
Balance: Fe and unavoidable impurities The 9 Cr-1 Mo steel composition may be initially prepared with precursor elemental charge materials, or commercially available steel in combination with precursor elemental or master alloy charge materials, provided the elemental ranges as outlined above are satisfied. The 9 Cr-1 Mo steel composition may be initially produced in any ordinary equipment and process generally employed in the prior art. For example, the 9 Cr-1 Mo steel composition may be initially melted in a furnace such as an electric furnace, a converter, a vacuum furnace, or the like. The melt may then be cast into slabs, billets, or ingots in a continuous casting method or a slab-making method, and thereafter shaped into pipe, sheet, bar, rod, or other applicable product forms. The thus produced 9 Cr-1 Mo steel composition may then be heat treated by austenization, rapid cooling, tempering, and final cooling, such that the final product is a 9 Cr-1 Mo steel having a tempered martensite microstructure and both primary TiC to limit grain growth, and secondary TiC for increased oxidation resistance and strength.

The 9 Cr-1 Mo steel comprised of the primary TiC grains and secondary TiC grains may be fabricated using the exemplary austenizing, rapid cooling, and tempering steps described below.

Heating to Austenization Temperature

Heating the 9 Cr-1 Mo steel composition to a specific quench temperature serves two primary purposes: (i) creating an austenite phase thereby enabling subsequent martensitic transformation for a portion of the austenite, and (ii) dissolution of approximately 50% of the primary TiC to place titanium and carbon in solution prior to rapid cooling. Typically, austenization temperatures of approximately 1050° C. are utilized for commonly used 9 Cr-1 Mo materials, such as ASTM P91 and ASTM P92, among others. However, in the heat treated 9 Cr-1 Mo steel composition of this invention, because dissolution of about 40-60% and preferably about 50% of the primary TiC is desired, and because TiC has extremely low solubility at 1050° C., a higher temperature is necessary. The necessary temperature for a given composition may be determined through methods known in the art, such as computational simulation using commercially available materials development software. One such suitable computational simulation is THERMO-CALC software. In one embodiment of the heat treated 9 Cr-1 Mo steel composition described herein, an austenization temperature of approximately 1250+/−20° C. maintained for about ten minutes is sufficient to result in dissolution of about 40-60% of the primary TiC. In this manner, about 40-60% of the primary TiC dissolves to produce titanium and carbon in solution, while the remaining, undissolved primary TiC of approximate size 0.5-3 μm remains in the material to enhance creep strength.

The 9 Cr-1 Mo steel composition utilized in the present disclosure is generally fully austenitic from about 960° C. to about 1160° C., however above 1160° C. some portion of the austenite will revert to the high temperature BCC phase (δ-ferrite). Subsequently, this portion of the microstructure in the high temperature BCC phase will not form martensite or bainite when rapidly cooled, resulting in a two-phase microstructure.

Rapid Cooling

After the 9 Cr-1 Mo steel composition is austenized at a temperature and time sufficient to dissolve approximately half of the primary TiC, the 9 Cr-1 Mo steel composition is rapidly cooled. Rapid cooling serves two primary purposes: (i) it produces the diffusionless displacive shear transformation that converts the austenite to martensite, and (ii) it suppresses the formation of secondary TiC particles, which require both diffusion and time. Under cooling conditions exceeding approximately 2° C./s, the 9 Cr-1 Mo steel composition rapidly reaches a temperature where the diffusivity of titanium is largely insufficient for significant precipitation of TiC dispersions. Thus, the rapid cooling effectively suppresses the precipitation of TiC dispersions and prevents the titanium from precipitating out of solution. This rapid removal of thermal energy also prevents the diffusion of carbon, and carbon remains in solution in the body centered tetragonal (BCT) configuration of martensite, as is well known. In one embodiment of the heat treated material of this invention, the 9 Cr-1 Mo steel composition is rapidly cooled by water quenching in order to convert austenite to martensite and suppress precipitation of TiC dispersions. This rapid cooling produces a substantially martensitic microstructure of martensite and δ-ferrite.

Tempering

After rapid cooling, the 9 Cr-1 Mo steel composition is tempered at a temperature exceeding the anticipated service temperature of the final Cr-1 Mo steel and below the Ac3 temperature. Tempering serves two primary purposes: (i) rearrangement of the martensite microstructure to form ferrite, and (ii) precipitation of secondary TiC. At tempering, the martensitic structure transforms into a more thermodynamically stable structure and the carbon atoms trapped in the martensite diffuse out of the distorted BCT structure, as is well known. Concurrently, in the 9 Cr-1 Mo steel composition utilized in the heat treated 9 Cr-1 Mo steel disclosed herein, titanium diffuses through the material bonding with free carbon, forming secondary TiC of about size 5-50 nm distributed within the matrix of the material. The strong affinity of titanium for carbon results in preferential formation of the secondary TiC and reduces the formation of chromium carbides, maintaining a higher level of chromium available for oxidation resistance. Additionally, the secondary TiC strengthens the metal by impeding the movement of dislocations through the crystal structure.

Tempering should be conducted at a temperature exceeding the intended service temperature and below the Ac3 temperature. In one embodiment of the heat treated 9 Cr-1 Mo steel intended for a 650° C. service temperature, a tempering temperature of about 755° C. maintained for about thirty minutes is sufficient to rearrange the martensitic microstructure and facilitate the precipitation of secondary TiC.

Final Cooling

Following tempering, the 9 Cr-1 Mo steel composition undergoes final cooling. In one embodiment of the heat treated 9 Cr-1 Mo steel composition, air cooling is employed. The heat treated 9 Cr-1 Mo steel formed is thus a martensitic steel for high temperature application containing primary TiC for grain size refinement and increased grain boundary strengthening, as well as finely precipitated secondary TiC distributed throughout the matrix of the material for increased creep strength, tensile strength, and corrosion resistance. The tempering temperature exceeds the service temperature of the heat treated material and therefore renders the heat treated 9 Cr-1 Mo steel stable in service conditions. This heat treated 9 Cr-1 Mo steel requires no additional hot working in the austenite range such as forging, rolling, extrusion, or the like, and exhibits improved high-temperature creep strength and improved oxidation and corrosion resistance over currently used high-temperature 9 Cr-1 Mo materials, such as ASTM P91 and ASTM P92, among others. The heat treated 9 Cr-1 Mo steel uses titanium as a major alloying element and avoids the use of comparatively more expensive alloying elements such as nickel, cobalt, or tungsten.

Comparison

A 9 Cr-1 Mo steel composition utilized in the 9 Cr-1 Mo steel of the present invention was prepared with the nominal composition (in wt. %) indicated in Table I. For comparison, Table I also includes the nominal compositions of commercial ASTM P91 and ASTM P92. In order to determine a heat treatment sufficient to cause dissolution of about 40-60% and preferably about 50% of the primary TiC, an austenization temperature of 1250° C. was determined using THERMO-CALC Software for the 9 Cr-1 Mo steel composition having the Table I composition. This temperature held for about 10 minutes was predicted to cause about 50% dissolution of the primary TiC, so that following tempering and subsequent cooling, the 9 Cr-1 Mo steel would contain secondary and primary TiC in a ratio of about 1:1.

The 9 Cr-1 Mo steel composition was produced by vacuum induction melting of elemental charge materials. The molten 9 Cr-1 Mo steel composition was poured and solidified in a cylindrical graphite mold 76 mm in diameter. After removing the hot tops and surface layer, the ingots were hot forged and rolled into 12 mm thick plate. The heat treated 9 Cr-1 Mo steel was produced by subjecting the plates to austenization at 1250° C. for 10 minutes, water quenching, tempering at 755° C. for thirty minutes, and air cooling. Oxidation specimens were cut in 25 mm×12 mm×3 mm dimensions. They were wet-ground to a 600 grit surface finish with SiC abrasive paper.

The thus produced heat treated 9 Cr-1 Mo steel was subjected to oxidation testing conducted in a tube furnace using air bubbled through two columns of distilled water to produce 3% moist air. The testing lasted up to 1500 hours at 650° C. Commercial, as-received ASTM P91 was similarly tested. The oxidation scales were examined using various analytical techniques including scanning electron microscopy, and wavelength-dispersive and energy-dispersive spectroscopy.

The mass gain of the heat treated 9 Cr-1 Mo steel compared to ASTM P91 is presented as a function of time in FIG. 1. As expected, each alloy showed a parabolic oxidation rate, and the mass gain of both specimens was due primarily to growth of oxidation scale on the surface. However, in a highly unexpected result, over the full test the total mass gain of the heat treated 9 Cr-1 Mo steel disclosed herein was about 5 times lower than ASTM P91. Comparing the Table 1 compositions of the heat treated 9 Cr-1 Mo steel disclosed and ASTM P91, the oxidation resistance improved substantially.

Tensile testing of the heat treated 9 Cr-1 Mo steel was performed at temperatures of 550° C., 600° C., and 650° C. using a screw driven machine at a 0.5 mm/min loading rate. Tensile results are shown in Table II. For comparison, Table II also includes published results for the average yield strength of commercial ASTM P91 steel at the tested temperatures. Again in an unexpected result, the yield strength of the heat treated 9 Cr-1 Mo steel was observed to be significantly higher than commercial ASTM P91 steel, demonstrating highly surprising improvements of approximately 27% at 550° C., 65% at 600° C., and 73% at 650° C.

Figure 2:
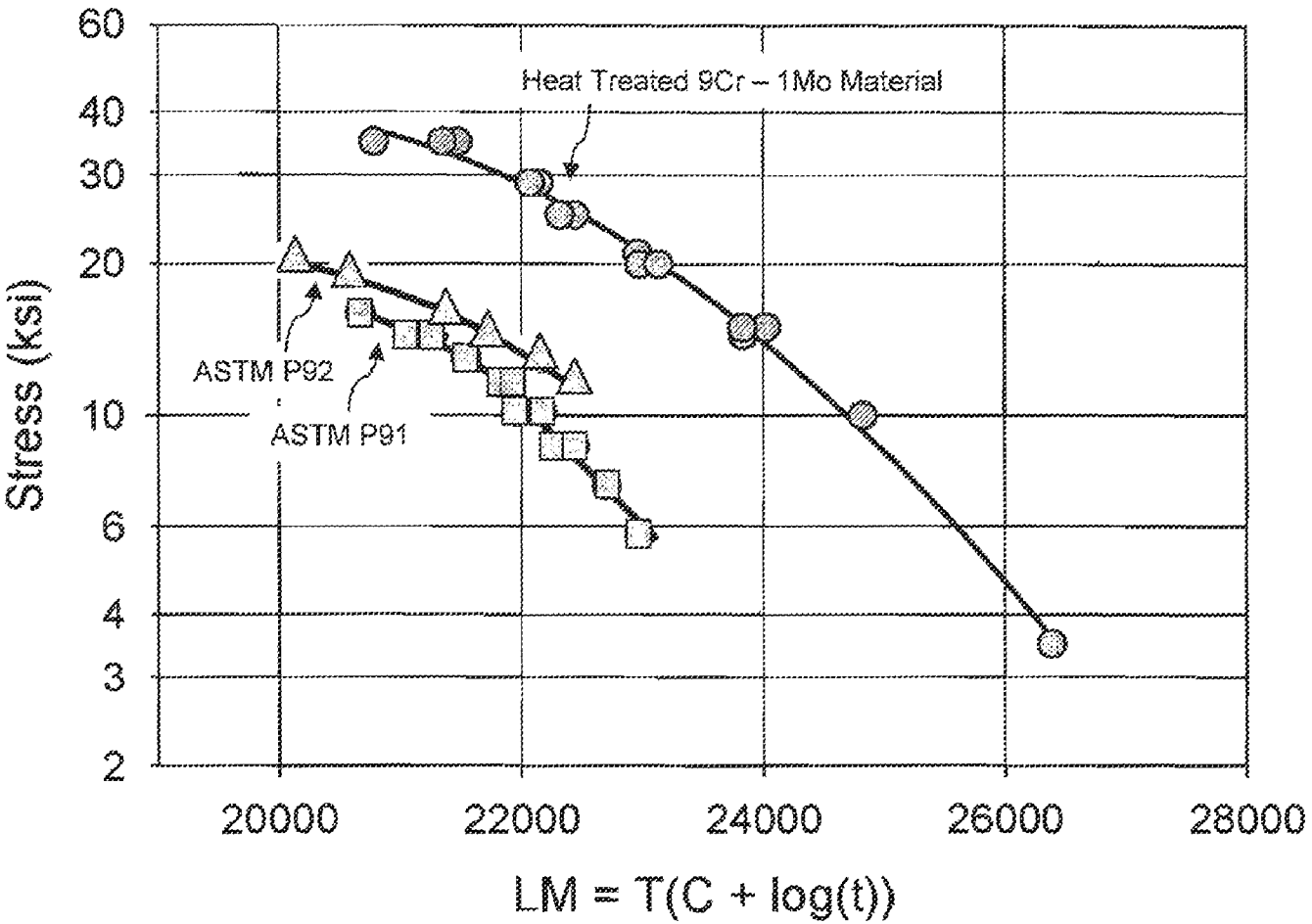
FIG. 2 shows the Larson-Miller Parameter for the heat treated 9Cr-1Mo steel and comparison materials ASTM P91 and ASTM P92, demonstrating improved creep performance of the heat treated material over ASTM P91 and ASTM P92.

FIG. 2 compares the Larson-Miller (L-M) parameter of the 9 Cr-1 Mo steel with published values for commercial ASTM P91 and commercial ASTM P92. The Larson-Miller parameter is an empirical number reflecting the operating temperature and the creep strength of the alloy, defined in FIG. 2 as L-M=T*(log(t)+22.4), where T is the test temperature in degrees Kelvin and t is the time in hours for rupture to occur at the test temperature. FIG. 2 indicates that the heat treated 9 Cr-1 Mo steel exhibits superior time-to-rupture over the currently used high-temperature 9Cr-1Mo materials ASTM P91 and ASTM P92 at all temperature and time conditions examined.

Thus, presented here is a 9 Cr-1 Mo steel having a tempered martensite microstructure and comprised of at least Fe, chromium, molybdenum, carbon, and titanium, and having primary TiC grains and secondary TiC grains in a ratio of from about 1:1.5 to about 1.5:1. The primary TiC grains are from about 0.5 μm to about 3.0 μm in diameter and the secondary TiC grains are from about 5 nm to about 50 nm in diameter. The tempered martensite microstructure is comprised of ferrite (α-Fe) and cementite ($Fe_3C$). The 9 Cr-1 Mo steel may be further comprised of silicon, manganese, vanadium, niobium, and nickel within the ranges prescribed. A 9 Cr-1 Mo steel may be fabricated by preparing a 9 Cr-1 Mo steel composition of the disclosed composition and conducting austenization, rapid cooling, tempering, and final cooling as indicated. The 9 Cr-1 Mo steel exhibits improved high-temperature creep strength and improved oxidation and corrosion resistance in a temperature environment of 625-650° C.

It is to be understood that the above-described arrangements are only illustrative of the application of the principles of the present invention and it is not intended to be exhaustive or limit the invention to the precise form disclosed. Numerous modifications and alternative arrangements may be devised by those skilled in the art in light of the above teachings without departing from the spirit and scope of the present invention. It is intended that the scope of the invention be defined by the claims appended hereto.

In addition, the previously described versions of the present invention have many advantages, including but not limited to those described above. However, the invention does not require that all advantages and aspects be incorporated into every embodiment of the present invention.

All publications and patent documents cited in this application are incorporated by reference in their entirety for all purposes to the same extent as if each individual publication or patent document were so individually denoted.

TABLE I

Compositions: 9 Cr—1 Mo alloy and comparison materials

| | C | Cr | Mn | Mo | W | V | Si | Nb | Ti | Balance |
|---|---|---|---|---|---|---|---|---|---|---|
| 9 Cr—1 Mo Steel | 0.1 | 8.75 | 0.45 | 0.95 | — | 0.22 | 0.35 | 0.08 | 0.1 | Fe, impurities |
| ASTM P91 | 0.1 | 8.75 | 0.45 | 0.95 | — | 0.22 | 0.35 | 0.08 | — | Fe, impurities |
| ASTM P92 | 0.1 | 8.75 | 0.45 | 0.95 | 1.75 | 0.22 | 0.35 | 0.08 | — | Fe, impurities |

TABLE II

Tensile test results: Heat treated 9 Cr—1 Mo material and comparison materials

| Temperature (C.) | Yield Strength (MPa) 9 Cr—1 Mo alloy | Yield Strength (MPa) Std P91 (ave) |
|---|---|---|
| 550 | 406 | 320 |
| 600 | 429 | 260 |
| 650 | 346 | 200 |

What is claimed is:

1. A 9 Cr-1 Mo steel having a tempered martensite microstructure and comprised of Fe, 8.0-13.0 wt. % chromium, 0.5-1.5 wt. % molybdenum, 0.05-0.15 wt. % carbon, and 0.05-0.2 wt. % titanium, where the 9 Cr-1 Mo steel material is comprised of primary TiC grains and secondary TiC grains, where a mass ratio of primary TiC grains to secondary TiC grains is from about 1:1.5 to about 1.5:1, where the mass ratio of primary TiC grains to secondary TiC grains is the mass of the primary TiC grains divided by the mass of the secondary TiC grains.

2. The 9 Cr-1 Mo steel of claim 1 where the primary TiC grains are from about 0.5 μm to about 3.0 μm in diameter, and where the secondary TiC grains are from about 5 nm to about 50 nm in diameter.

3. The 9 Cr-1 Mo steel of claim 2 where the primary TiC grains are comprised of a first portion of the 0.05-0.2 wt. % titanium and a first portion of the 0.05-0.15 wt. % carbon, and where the secondary TiC grains are comprised of a second portion of the 0.05-0.2 wt. % titanium and a second portion of the 0.05-0.15 wt. % carbon.

4. The 9 Cr-1 Mo steel of claim 3 comprised of 8.0-9.5 wt. % chromium, 0.85-1.05 wt. % molybdenum, 0.08-0.12 wt. % carbon, and 0.05-0.15 wt. % titanium.

5. The 9 Cr-1 Mo steel of claim 3 further comprised of silicon, manganese, vanadium, and niobium.

6. The 9 Cr-1 Mo steel of claim 5 further comprised of nickel.

7. The 9 Cr-1 Mo steel of claim 5 comprised of 0.1-1.0 wt. % silicon, 0.2-1.0 wt. % manganese, 0.1-0.4 wt. % vanadium, and 0.02-0.2 wt. % niobium.

8. The 9 Cr-1 Mo steel of claim 5 comprised of 8.0-9.5 wt. % chromium, 0.85-1.05 wt. % molybdenum, 0.08-0.12 wt. % carbon, 0.05-0.15 wt. % titanium, 0.2-0.5 wt. % silicon, 0.2-0.5 wt. % manganese, 0.18-0.25 wt. % vanadium, and 0.06-0.1 wt. % niobium.

9. The 9 Cr-1 Mo steel of claim 8 further comprised of 0.4 wt. % or less nickel.

10. A 9 Cr-1 Mo steel having a tempered martensite microstructure and comprised of primary TiC grains and secondary TiC grains, where the primary TiC grains are from about 0.5 μm to about 3.0 μm in diameter, and where the secondary TiC grains are from about 5 nm to about 50 nm in diameter, and where a mass ratio of primary TiC grains to secondary TiC grains is from about 1:1.5 to about 1.5:1, where the mass ratio of primary TiC grains to secondary TiC grains is the mass of the primary TiC grains divided by the mass of the secondary TiC grains, and where the 9 Cr-1 Mo steel is comprised of Fe, 8.0-13.0 wt. % chromium, 0.5-1.5 wt. % molybdenum, 0.05-0.15 wt. % carbon, 0.05-0.2 wt. % titanium, silicon, manganese, vanadium, niobium, and nickel.

11. The 9 Cr-1 Mo steel of claim 10 where the primary TiC grains are comprised of a first portion of the 0.05-0.2 wt. % titanium and a first portion of the 0.05-0.15 wt. % carbon, and where the secondary TiC grains are comprised of a second portion of the 0.05-0.2 wt. % titanium and a second portion of the 0.05-0.15 wt. % carbon.

12. The 9 Cr-1 Mo steel of claim 11 comprised of 0.1-1.0 wt. % silicon, 0.2-1.0 wt. % manganese, 0.1-0.4 wt. % vanadium, 0.02-0.2 wt. % niobium, and 0.8 wt. % or less nickel.

13. The Cr-1 Mo steel of claim 12 comprised of 8.0-9.5 wt. % chromium, 0.85-1.05 wt. % molybdenum, 0.08-0.12 wt. % carbon, 0.05-0.15 wt. % titanium, 0.2-0.5 wt. % silicon, 0.2-0.5 wt. % manganese, 0.18-0.25 wt. % vanadium, and 0.06-0.1 wt. % niobium.

14. A 9 Cr-1 Mo steel having a tempered martensite microstructure and comprised of, Fe,
8.0-9.5 wt. % chromium,
0.85-1.05 wt. % molybdenum,
0.08-0.12 wt. % carbon,
0.05-0.15 wt. % titanium,
0.2-0.5 wt. % silicon,
0.2-0.5 wt. % manganese,
0.18-0.25 wt. % vanadium,
0.06-0.1 wt. % niobium and,
0.4 wt. % or less nickel, where the 9 Cr-1 Mo steel is comprised of primary TiC grains and secondary TiC grains, where the primary TiC grains are from about 0.5 μm to about 3.0 μm in diameter, and where the secondary TiC grains are from about 5 nm to about 50 nm in diameter, and where a mass ratio of primary TiC grains to secondary TiC grains is from about 1:1.5 to about 1.5:1, where the mass ratio of primary TiC grains to secondary TiC grains is the mass of the primary TiC grains divided by the mass of the secondary TiC grains, and where the primary TiC grains are comprised of a first portion of the 0.05-0.15 wt. % titanium and a first portion of the 0.08-0.12 wt. % carbon, and where the secondary TiC grains are comprised of a second portion of the 0.05-0.15 wt. % titanium and a second portion of the 0.08-0.12 wt. % carbon.

* * * * *